United States Patent [19]

Morgan

[11] 4,070,075

[45] Jan. 24, 1978

[54] AMMUNITION LOADING BENCH

[76] Inventor: Robin H. Morgan, 2526 W. 18 St., Los Angeles, Calif.

[21] Appl. No.: 625,269

[22] Filed: Oct. 23, 1975

[51] Int. Cl.[2] ..... A47B 91/00; A47B 88/00; A47B 35/00; A47G 29/00

[52] U.S. Cl. ..... 312/250; 312/281; 312/324; 108/50; 248/346; 269/1

[58] Field of Search ..... 312/250, 281, 282, 276, 312/324; 248/188.4, 25, 158, 346; 269/1, 3, 4, 289 R, 321 R, 321 CF, 321 W; 108/159, 158, 160, 50

[56] References Cited

U.S. PATENT DOCUMENTS

| | | | |
|---|---|---|---|
| 739,662 | 9/1903 | Francisco et al. | 312/282 |
| 849,999 | 4/1907 | Hendricks | 312/250 |
| 912,168 | 2/1909 | Reese | 312/282 |
| 972,356 | 10/1910 | Funk | 108/159 |
| 1,294,685 | 2/1919 | McCord | 312/276 |
| 1,864,880 | 6/1932 | Zimmerman | 86/23 |
| 1,979,603 | 11/1934 | Bosler | 86/23 |
| 2,212,001 | 8/1940 | Anetsberger | 312/281 |
| 2,253,475 | 8/1941 | Willber | 312/281 |
| 2,422,430 | 6/1947 | Manderscheid et al. | 269/289 M |
| 2,574,769 | 11/1951 | Thomas | 312/276 |
| 2,666,679 | 1/1954 | Olofsson | 312/282 |
| 2,680,326 | 6/1954 | Sultan | 248/188.4 |
| 2,716,045 | 8/1955 | Berner | 312/281 |
| 3,031,782 | 5/1962 | Frye | 312/281 |
| 3,105,727 | 10/1963 | Anders | 312/281 |
| 3,195,881 | 7/1965 | Morell | 269/321 R |
| 3,451,738 | 6/1969 | Hobson | 312/282 |
| 3,765,666 | 10/1973 | Chretiennot | 269/289 |

FOREIGN PATENT DOCUMENTS

| | | | |
|---|---|---|---|
| 237,837 | 6/1964 | Austria | 312/282 |
| 785,874 | 8/1935 | France | 312/281 |

*Primary Examiner*—Paul R. Gilliam
*Assistant Examiner*—V. N. Sakran
*Attorney, Agent, or Firm*—William P. Green

[57] ABSTRACT

An ammunition loading bench preferably including a cabinet movably mounted on supporting wheels and having a rigid top plate to which a loading press is connectable, with weights being connected to and hanging downwardly from the top plate to take forces exerted thereagainst, and with the plate and weights being detachable from the cabinet for use separately therefrom to mount a press with the plate resting on a generally horizontal support surface and held downwardly thereagainst by placement of the weights on the upper side of the plate. Desirably, in both uses, a foot pedal is connected to the plate, directly or indirectly, to exert downward force thereagainst resisting upward forces exerted by the press against the portion of the plate to which the press is mounted.

27 Claims, 18 Drawing Figures

FIG.3.
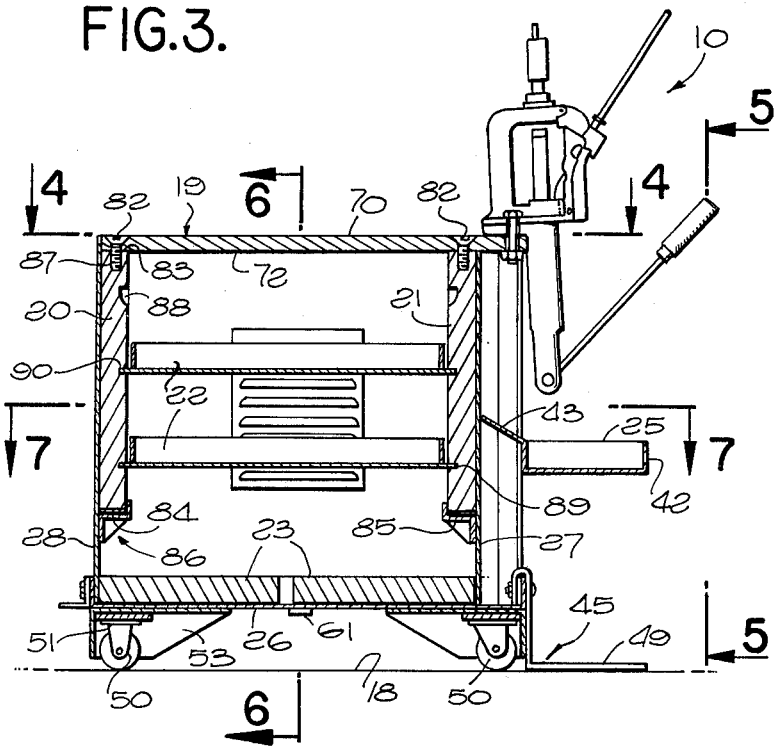
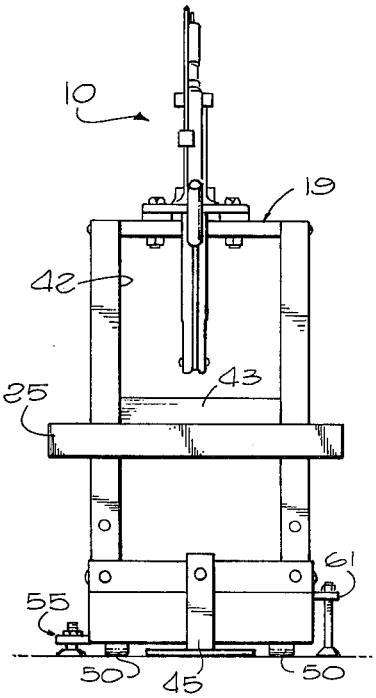
FIG. 5.
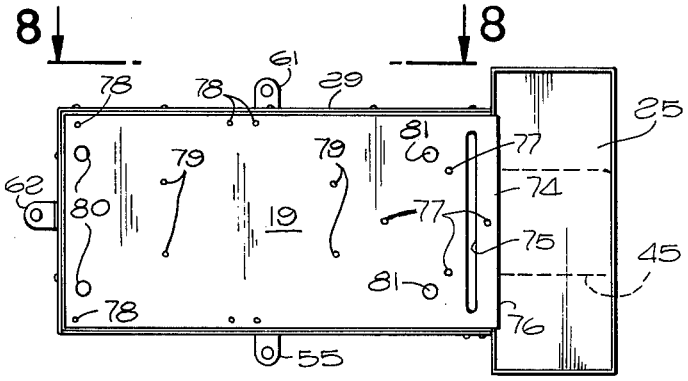
FIG. 4.
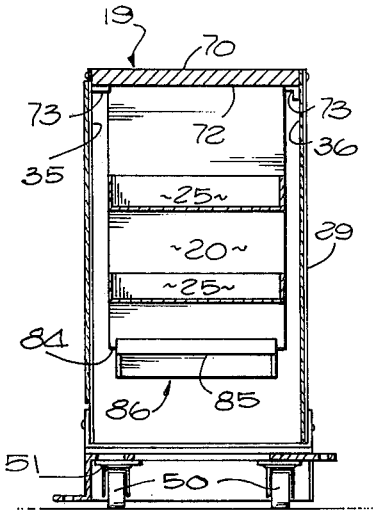
FIG. 6.
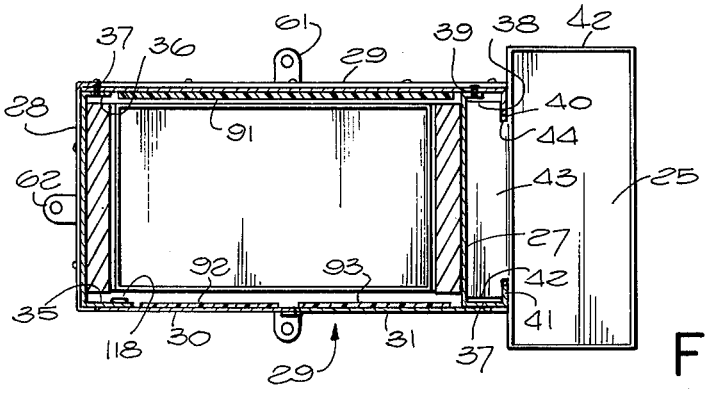
FIG. 7.

AMMUNITION LOADING BENCH

BACKGROUND OF THE INVENTION

This invention relates to improved benches or equipment for mounting a loading press to be used in loading or reloading gun ammunition. Certain features of the invention have been disclosed in Disclosure Document No. 029484 filed Mar. 11, 1974 and Disclosure Document No. 041172 filed May 21, 1975.

In recent years, it has become increasingly more popular for gun enthusiasts to load or reload their own shells with powder, bullets, shot, etc. Such loading or reloading results in a very considerable saving in overall cost for each round fired and in addition enables a person to tailor the powder and bullet or shot charge to his own individual specifications and desires, and thereby achieve or approach effects which cannot be attained by standard purchased ammunition.

Though many persons wish to load or reload ammunition for these purposes, a large percentage of these persons do not have accessible an appropriate work bench which can satisfactorily support a loading press and effectively take the upward and downward forces which are necessarily exerted by the press against its support in use.

SUMMARY OF THE INVENTION

The present invention provides a novel loading bench which is especially constructed for mounting a loading press, and holding it rigidly in fixed position during a loading operation and in spite of the very substantial forces which are exerted by the press during the various steps of a loading operation. The bench can be portable to be easily movable from one location to another, and can be positioned in virtually any convenient location, even within the interior of the living quarters in a home. When not in use, the bench can present the appearance of an enclosed cabinet, within which the loading supplies can be concealed, and when desired can be very readily and quickly converted to a condition of use. Also, certain portions of the bench can be separated from the bench and taken to a field location at which ammunition is to be fired so that a user may actually reload the ammunition in the field in a manner very precisely tailoring the powder and bullet or shot charges to compensate for or satisfy any particular firing conditions which may be encountered.

Structurally, the bench preferably includes a support structure, desirably taking the form of walls forming an enclosed cabinet, with a rigid top plate connected to an upper portion of the support structure and adapted to mount a loading press and with weight means (preferably two spaced weights) detachably connected to the underside of the plate and having sufficient mass to prevent displacement of the weight of most of the forces which may be encountered in a loading operation. The top plate and weight means may be separable from the cabinet structure for use in the field, with the mounting plate being positioned on any generally horizontal surface, and the weights being positioned on the upper side of the mounting plate to hold it downwardly against the surface. A foot pedal structure may extend downwardly from the plate when employed in this manner, so that the foot of a user may exert downward force against the plate through the foot pedal structure to resist upward displacement of the connected portion of the plate and the press. A similar foot pedal may be provided on the main cabinet itself. In some instances, it is contemplated that the support plate and weights, preferably in conjunction with the foot pedal structure, can be provided independently of any main cabinet structure.

Certain additional features of the invention relate to preferred structural features of the cabinet and its related parts, including support elements for temporarily supporting the weights during their attachment to the top plate, an outrigger bracket for supporting additional weights, vertically adjustable stabilizing feet to be connected to the cabinet and engage a floor surface at different sides thereof, and other structural arrangements to be discussed hereinbelow.

BRIEF DESCRIPTION OF THE DRAWINGS

The above and other features and objects of the invention will be better understood from the following detailed description of the typical embodiments illustrated in the accompanying drawings in which:

FIG. 3 is an enlarged vertical section taken on line 3—3 of FIG. 1;

FIG. 4 is a plan view of the bench taken on line 4—4 of FIG. 3;

FIG. 5 is an end elevational view taken on line 5—5 of FIG. 3;

FIG. 6 is a transverse vertical section taken on line 6—6 of FIG. 3;

FIG. 7 is a horizontal section taken on line 7—7 of FIG. 3;

Figure 11:
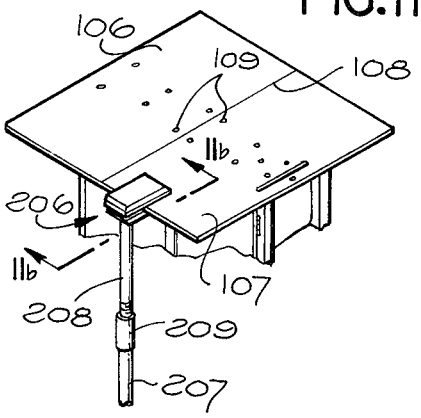
FIG. 11 is a fragmentary perspective view similar to FIG. 1, but showing two additional top plates attached to the top of the bench, together with a stabilizing leg assembly.
Figure 12:
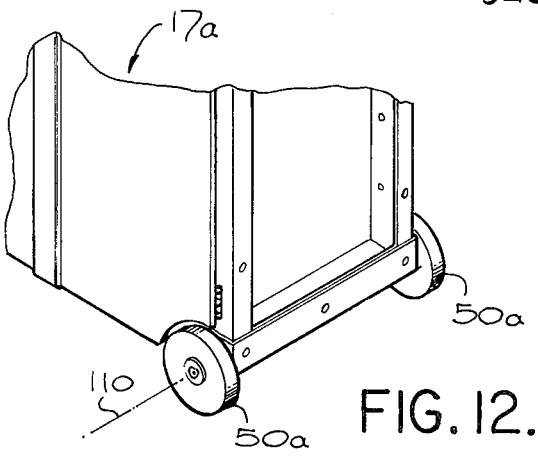
Figure 13:
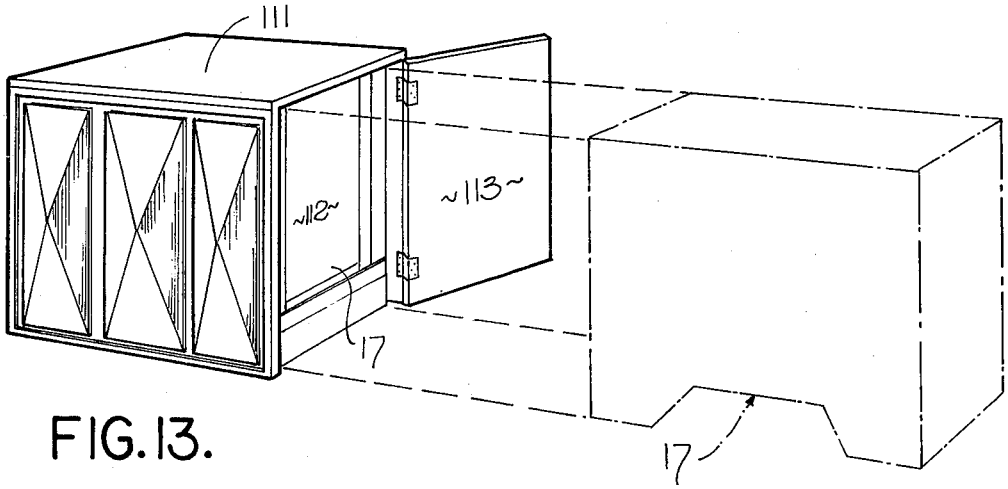
Figure 14:
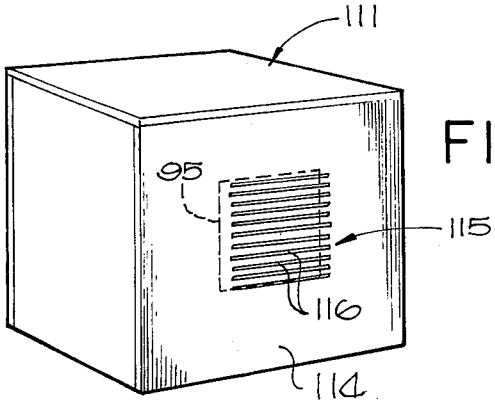
Figure 16:
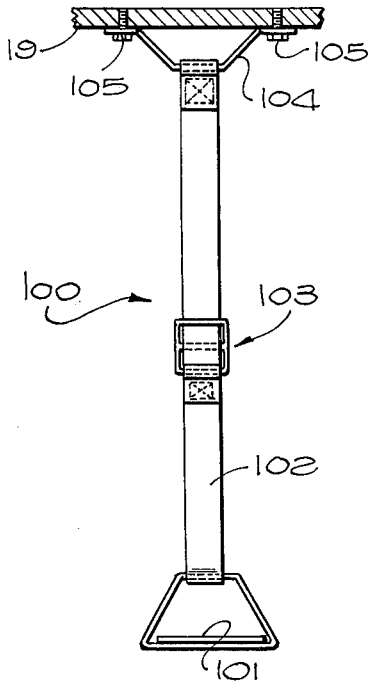
Figure 15:
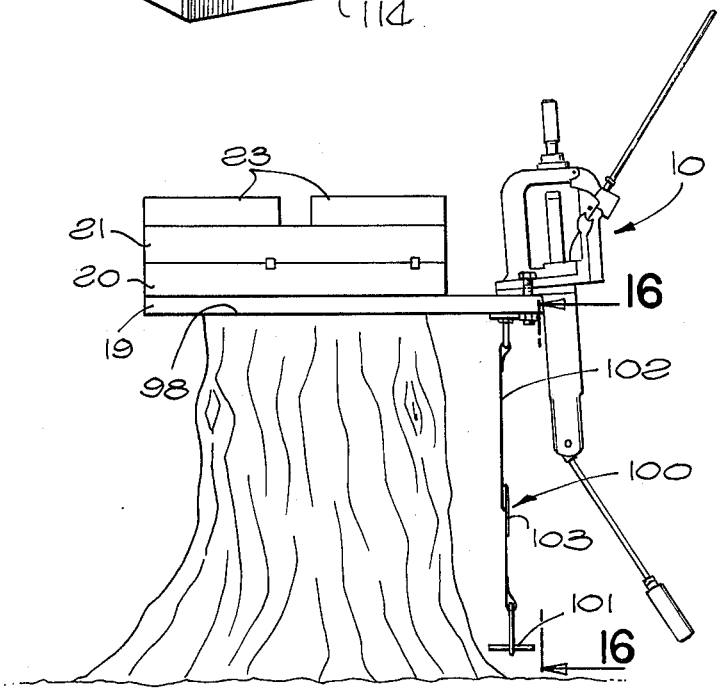

FIG. **11*a* is a fragmentary exploded perspective view of the leg assembly of FIG. 11**;

FIG. **11*b* is an enlarged section on line 11*b*—11*b* of FIG. 11**;

FIG. 12 is a fragmentary perspective view of a lower portion of a variational arrangement;

FIG. 13 illustrates in perspective an outer decorative cabinet disposed about the bench;

FIG. 14 shows the back side of the FIG. 13 bench;

FIG. 15 shows the manner in which the top plate and weights of the bench can be utilized for field loading; and FIG. 16 is a vertical section taken on line 16—16 of FIG. 15.

DESCRIPTION OF THE PREFERRED EMBODIMENTS

Figure 1:
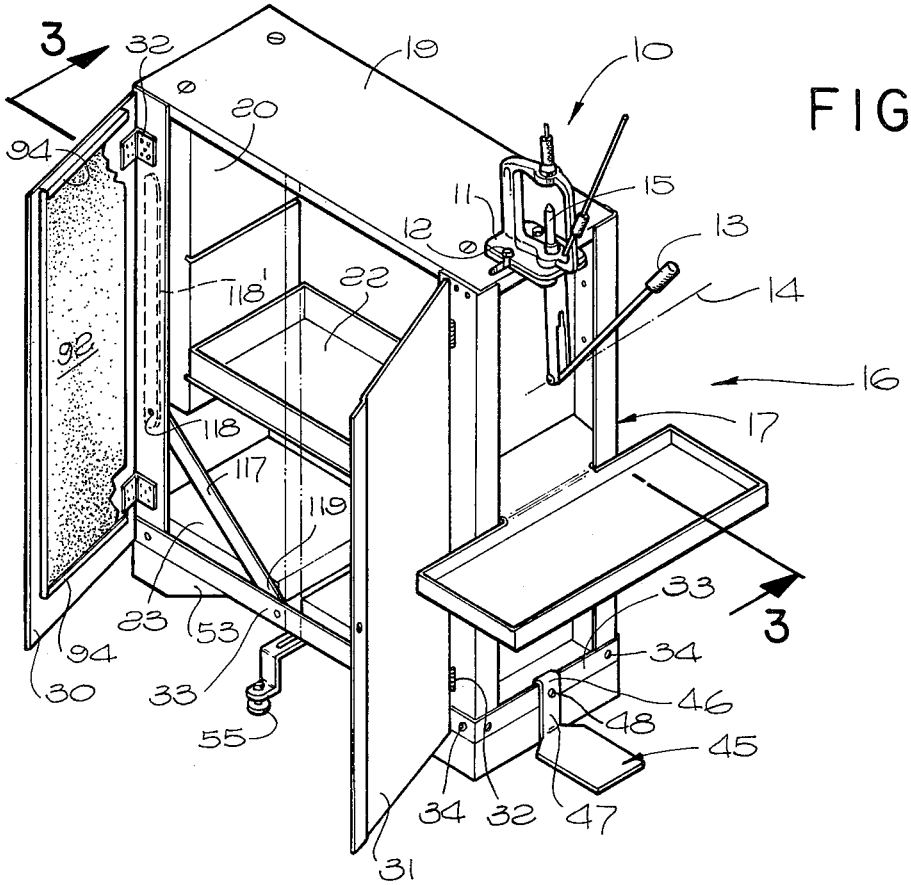
FIG. 1 is a perspective view of a first form of loading bench embodying the invention.

With reference first to FIGS. 1 and 3, there is illustrated at 10 a typical ammunition loading or reloading press, which may be of any known or desired type, and which normally has a lower mounting base 11 adapted to be held rigidly in place by bolts 12 extending downwardly through openings in the base and through registering openings in an underlying mounting structure. The press has an actuating arm or handle 13 which is mounted to the base for manual up and down swinging movement about a horizontal axis 14 to move a ram element 15 upwardly and/or downwardly for performing the various operations desired in loading and reloading ammunition, such as for removing primers from used rifle, pistol, or shotgun shells, reshaping the shell cases, forcing projectiles into the shells, crimping the shell cases, etc. Some of these operations require exertion of very substantial force by the plunger, and manually in upward and downward directions against the swinging lever handle 13.

The illustrated loading bench 16 constructed in accordance with the invention is designed to effectively take these heavy forces exerted against or by the press in use, an includes an upstanding generally rectangular cabinet 17 mounted on wheels for movement to different positions along a floor surface 18 and carrying at its upper end a rigid top plate 19 from which two spaced depending weights 20 and 21 are suspended, with removable trays 22 received therebetween. Additional weights 23 may be received in the lower portion of the cabinet. At its forward end, the cabinet removably carries a foot pedal element 24 against which downward force may be exerted by the foot of the user, and an additional removable tray 25.

Figure 9:
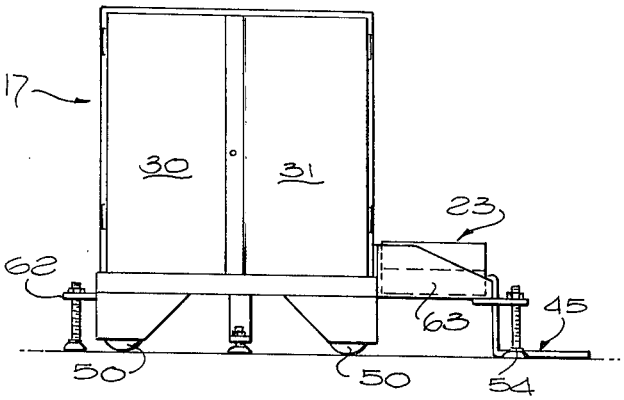
FIG. 9 is a side elevational view showing the bench with an outrigger bracket attached thereto.

The cabinet 17 is of essentially rectangular configuration, having a horizontal rectangular bottom wall 26, vertical essentially parallel front and rear walls 27 and 28, a rectangular vertical side wall 29 perpendicular to walls 27 and 28, and two swinging doors 30 and 31 hindged at 32 to walls 27 and 28 for swinging movement about vertical axes between the open condition illustrated in full lines in FIG. 1 and the closed condition of FIG. 9 in which they form together a second vertical side wall parallel to wall 29.

Figure 2:
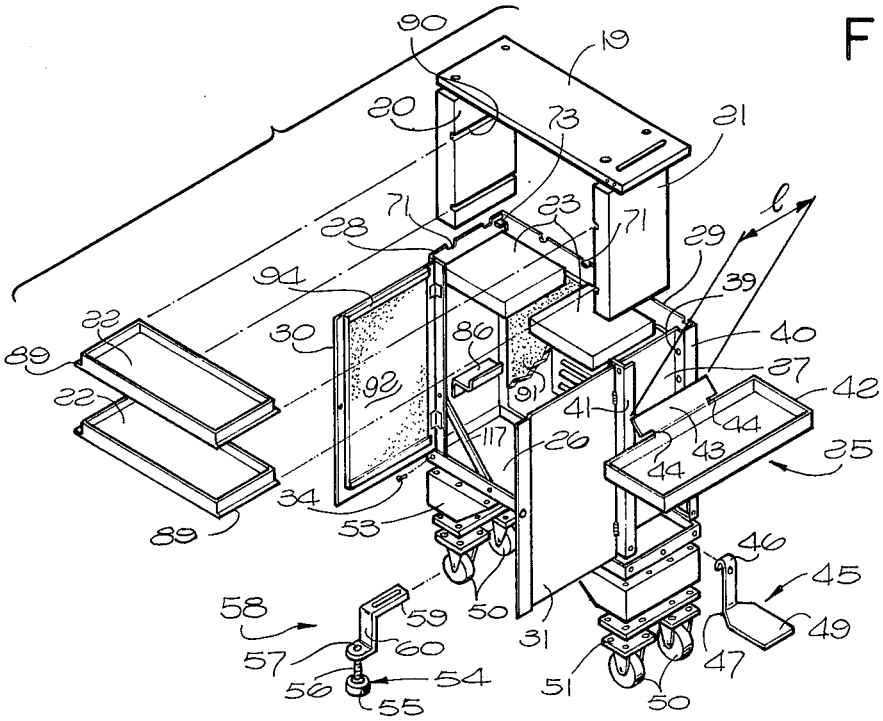
FIG. 2 is an exploded perspective view of the FIG. 1 bench.
Figure 8:
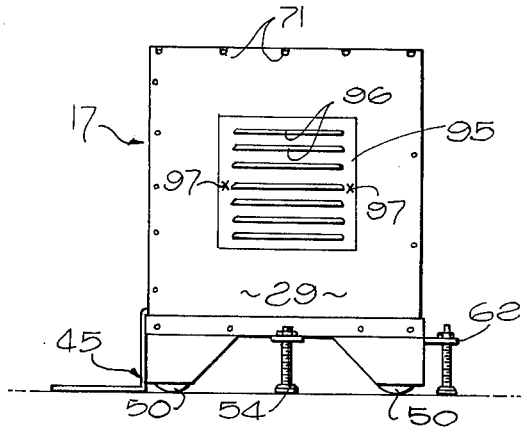
FIG. 8 is a side view taken on line 8—8 of FIG. 4.

As seen in FIG. 2, the bottom wall 26 of the cabinet may have upstanding flanges 33 entirely about its periphery for rigid attachment by a series of screws 34 to the lower edge portions of walls 27, 28, and 29. Rear wall 28 may have the cross sectional configuration illustrated in FIG. 7 to present two flanges 35 and 36, the first of which mounts the hinges of door 30, and the second of which is rigidly connected by screws 37 to wall 29. The front wall 27 has a vertical flange 37 which mounts the hinges for door 31, and a second vertical flange 38 at its opposite side which is attached by screws 39 to side wall 29. Wall 29 has at its forward extremity a vertical flange 40 which is turned to be parallel to the main portion of front wall 27, and which extends vertically along the entire height of wall 29, as does a similar flange 41 formed by the material of wall 27 in planar alignment with flange 40. Thus, walls 27 and 29 form together at the front of the cabinet a recess 42 of rectangular horizontal cross section which extends vertically along the entire height of the cabinet and which has the two discussed vertical aligned flanges 40 and 41 extending inwardly from its opposite sides for use in mounting tray 25. This tray is horizontal when in use, and has a peripheral flange 42 from which a planar upwardly and inwardly inclined rectangular mounting portion 43 extends. This mounting portion is dimensioned to have a horizontal length L just slightly less than the corresponding horizontal width of recess 42, to be receivable within that recess with slots 44 (FIG. 2) of the tray structure receiving the two flanges 40 and 41 of the cabinet, so that the tray can be easily and removably attached to the cabinet by merely inserting portion 43 of tray 25 into recess 42, adjusting the tray vertically to any desired position, and then releasing the tray to swing downwardly by its own weight to a position in which flanges 40 and 41 are clamped between the opposite edges of slots 44 in a manner locking the plate against downward movement. The foot pedal 24 may be detachably connected to the foward end of the cabinet, by slipping the upper inverted U-shaped portion 46 of the foot pedal mounting arm 47 over the cabinet flange 33 at the bottom of recess 42, and then retaining these parts together by a screw 48 extending through registering opening in the parts, with the lower foot engageable portion 49 of the foot pedal extending horizontally when so mounted and preferably being in engagement with floor surfaced 18 on which the bench is supported.

At its underside, bottom wall 26 of the cabinet carries a number of floor engaging wheels 50 (preferably four such wheels) which in the FIG. 1 arrangement take the form of casters, mounted by conventional caster mounting assemblies 51 to swing around individual vertical axes to enable the cabinet to rool on the casters in any desired direction. The casters may be connected to mounting plates 52 connected to the underside of bottom wall 26, and be shielded from view by skirt 53 also secured to the bottom wall 26 and extending along the ends and sides of the caster assemblies as shown.

Figure 10:
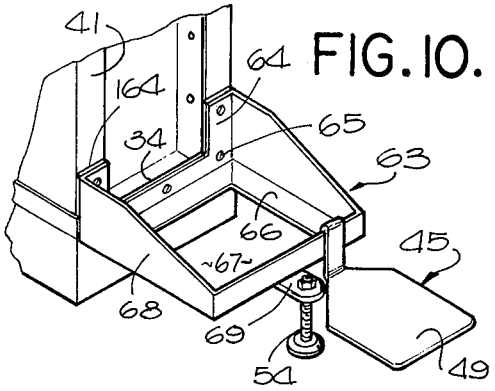
FIG. 10 is a fragmentary perspective view of the outrigger bracket.

For further stabilizing the cabinet and preventing movement thereof during a loading operation, there are provided four vertical adjustable foot elements 54 to be mounted to bottom 26 at the centers of the four sides of the cabinet. Each of these foot elements has a lower enlarged essentially horizontal floor engaging portion 55 and a threaded stem 56 projecting upwardly therefrom and connectable into a threaded opening 57 of a mounting part to enable adjustment of the foot to exactly the plane of the floor. In FIG. 2, there is illustrated at 58 one of the mounting elements for the foot 54 which is received at the door side of the cabinet. This element 58 has a mounting portion 59 containing a slot by which it is adjustably connected to the underside of the cabinet by a screw extending upwardly through slot 59' and connecting to bottom wall 26 of the cabinet. Element 58 may have a portion extending downwardly at 60 to carry the ear 57' having threaded opening 57 at a lower elevation. At the opposite side of the cabinet, a horizontally projecting ear or lug 61 adjustably carries a second of these foot elements 54, while a similar lug 62 is provided at the back end of the cabinet. The forward foot element when in use may be carried by a detachable outrigger bracket or tray 63 which is illustrated in FIGS. 9 and 10. This tray has at its back side a vertical flange portion 64 which is connectable rigidly by screws 65 to flanges 34, 40, and 41 of the cabinet, with two spacer plates 164 preferably being provided between the upwardly projecting portions of flange 64 and flanges 40 and 41 so that all portions of flange 64 may lie in a common vertical plane. When thus attached, the floor portion 66 of tray 63, which may contain an opening 67 as shown, extends horizontally, and is surrounded by upstanding side and end flanges 68 forming a recess which is square in horizontal section and dimensioned to receive and support the two previously mentioned weights 23 which may have the same square horizontal cross section (See FIG. 9). The forwardmost portion of tray 63 has a forwardly projecting lug 69 containing a threaded opening within which the fourth of the foot elements 54 is adjustably received. Also. when tray 63 is in use, the foot pedal unit 45 may be attached to the forward upstanding flange of tray 63, as seen in FIG. 10. When thus attached, as in its originally described position, the lower foot engageable horizontal portion 49 of the foot pedal element is at a level to engage the floor surface 18 on which the cabinet rests.

Top plate 19 of the bench is preferably relatively thick and formed of a very strong and rigid metal, to effectively avoid distortion by forces exerted against the plate in use. This plate has parallel horizontal upper and lower surfaces, and is of a rectangular horizontal cross section (see FIG. 4) to fit closely within the rectangular space defined by the top edges of the vertical walls of the cabinet. More particularly, the upper edges of the rear wall 28 and side wall 29 extend upwardly at the outside of and adjacent the corresponding edges of top plate 19, to the level of the upper horizontal surface 70 of the top plate. Formed in the upper edge portions of these walls are a series of spaced vertically extending upwardly opening slots 71 through which there may extend screws which are threadedly connected horizontally into the side edges of plate 19, and have heads tightenable against the outer surfaces of walls 28 and 29 to rigidly but detachably secure the top plate to the cabinet walls. The main portion and flange 38 of front wall 27 of the cabinet may terminate upwardly in a horizontal plane spaced beneath the plane of top surface 70 of plate 19, to engage the planar horizontal undersurface 72 of the plate 19 in a relation supporting the plate at that location. The opposite end of the plate may be similarly supported by angle brackets 73 connected to flanges 35 and 36 of rear wall 28 and having horizontal portions projecting inwardly at a level to engage the underside of plate 19 in supporting relation. The flanges 37 and 41 of forward wall 27 of the cabinet may project upwardly beyond the remainder of the front wall and to the level of the top surface of top plate 19, to locate the plate laterally at that position and be connectable by screws to the plate. It will thus be apparent that the top plate 19 has a forward portion 74 which overhangs recess 42, and which is therefore accessible from both its upper and lower sides for attachment of press 10 thereto.

As seen in FIG. 4, the top plate 10 contains an arrangement of openings which are so shaped and positioned as to enable attachment to the top plate of most of the conventional loading presses now on the market, by screws extending downwardly through the mounting openings of the presses and through these various openings in the top plate. The pattern of openings in plate 19 desirably includes an elongated slot 75 extending generally parallel to and in close proximity to the front edge 76 of the plate. This slot and four tapped openings 77 arranged as shown are desirably formed in the forward portion of the plate which overhangs recess 42. Additional tapped openings are desirably provided at 78, and further openings countersunk at both the top and bottom of the plate may be provided at 79. Near the opposite ends of the plate there may be formed two pairs of somewhat larger unthreaded openings 80 and 81 extending through the thickness of the plate and countersunk at their upper to receive screws 82 which extend downwardly through the top plate and connect threadedly into the upper ends of weights 20 and 21 to connect those weights rigidly to plate 19 and suspend them from the plate.

Weights 20 and 21 are desirably identical and of the illustrated vertically elongated rectangular shape, to prevent upper flat end surfaces 83 which engage the horizontal undersurface 72 of plate 19. At their lower ends, the weights 20 and 21 have horizontal planar bottom surfaces 84, which are engageable with and supportable by horizontal portions 85 of brackets 86 carried by cabinet end walls 27 and 28. When the weights 20 and 21 are supported on brackets 86, and are received against the end walls of the cabinet, openings 80 in the top plate are aligned vertically with tapped recesses 87 formed in the upper ends of weights 20 and 21, and the upper ends of the weights are received in close proximity to but not in engagement with the undersurface 72 of plate 19. In this condition, screws 82 are long enough to extend downwardly through openings 80 and 81 and connected threadedly into weights 20 and 21 while they are still supported by brackets 86. As the screws 82 are then tightened, they pull weights 20 and 21 upwardly a short distance and tightly against the undersurface 72 of plate 19, and in doing so move the lower surfaces 84 of weights 20 and 21 upwardly slightly above portions 85 of brackets 86, and no longer in contact therewith, so that the weights 20 and 21 are then supported only by top plate 19. For facilitating removal of weights 20 and 21 from the cabinet when desired, these weights may have fingergrip recesses 88 into which a user may insert his fingers to lift the weights.

The trays 22 within the cabinet are supported removably by and between the two weights 20 and 21. For this purpose, these trays may have elongated horizontal flanges 89 at their opposite ends which are slidably receivable within horizontal grooves 90 in the inner surfaces of weights 20 and 21, so that the trays can be slid horizontally into positions of connection to and suspension by the weights when doors 30 and 31 are open. These trays can be used to store loading supplies, such as powder, shells, bullets, shot, etc.

To assist in protecting any powder which may be contained in the cabinet from overheating in the event of fire at the outside of the cabinet, the wall 29 and doors 30 and 31 may carry at their inner sides sheets 91, 92, and 93 of heat insulative fire-proof material, such as asbestos or the like. The sheets 92 and 93 may be rectangular and slidably insertable into positions of retention against the inner sides of doors 30 and 31 by elongated top and bottom guideway brackets or slides 94 carried by the doors. The insulative sheet 91 may be secured to wall 29 by screws extending through the wall and the insulative material. In the event of accidental ignition of gun powder contained within the cabinet, it is desirable to provide a weakened portion of one of the walls to enable the force of the combustion gases to escape without development of the explosive force by confinment. For this purpose, wall 29 preferably contains a central square opening across which there extends a square plate 95, which is weaker than the material of the rest of the walls and doors, and may contain apertures 96, and is preferably only secured to wall 29 by spotwelds at two locations 97 at the centers of the two vertical edges of plate 95. The insulation material 91 may be interrupted at the location of this plate 95. Upon the development of increased pressure within the cabinet, the upper and lower portions of plate 95, above and beneath the locations of the two spotwelds 97, are forced outwardly away from wall 29, with the plate 95 bending along a horizontal line extending between the two spotwelds, to thus provide a very open path for the gases to leave the interior of the cabinet.

During most loading operations, the bench may be in the condition illustrated in FIGS. 1 to 8, with the two main weights 20 and 21 (typically about 47 pounds each)) suspended from top plate 19, and with the preferably smaller weights 23 resting on bottom wall 26 of the cabinet near its front and rear ends respectively. With the bench in this condition, a user may exert heavy forces upwardly and downwardly against actuating lever 13 of the press 10, to perform loading and reloading operations, with those forces being taken effectively by the very rigid upper structure consisting of top plate 19 and its depending weights 20 and 21, and by the heavy mass of weights 20, 21 and 23. When unusually heavy upward forces may be exerted against lever 13, the user places one of his feet on foot pedal 24, to apply a further downward force against the forward end of the cabinet for resisting the upward forces exerted against the press. The engagement of the four foot elements 54 with the floor surface at different sides of the cabinet adds further to the stability of the bench, and assists in maintaining it in fixed position on the floor. When desired, the forward tray 63 can be connected to the front end of the device, and weights 23 or additional similar weights can be mounted on that tray to thereby exert localized downward force against the front end of the bench in another way.

When it is desired to perform a loading or reloading operation in the field, top plate 19 and weights 20, 21 and 23 are removed from cabinet 17, and utilized in the manner illustrated in FIG. 15. The top plate is removed by detachment of its edge retaining screws, and by removing screws 82 which secure it to weights 20 and 21. After removal of trays 22, weights 20 and 21 may then by lifted upwardly from the open upper end of the cabinet. In the field, these parts may be mounted on any convenient horizontal supporting surface 98, which is typically illustrated in FIG. 15 as the upper surface of a tree trunk 99, but which may be any other available surface such as the top of an opened tailgate of a truck or station wagon, the top of a table, or the like.

When using the removed parts in this manner, top plate 19 is placed on the horizontal surface 98 with its forward portion preferably projecting beyond that surface and carrying the press 10 at its upper side. Weights 20, 21 and 23 are then placed on top of plate 19 at a location rearwardly of the press, to hold that portion of the top plate downwardly tightly against surface 98. These weights will thus tend to resist both upward and downward forces exerted against the handle lever 13 of the press. In order to further resist upward forces exerted against the press, I preferably provide an additional foot pedal assembly 100, which is connectable to the forward portion of the plate and depends therefrom to carry a foot pedal element 101 against which a user's foot can exert downward force. This element 101 is preferably carried by an elongated flexible member 102, preferably a belt as shown, which may have an adjusting portion 103 for varying the length of assembly 100 to thereby adjust the level at which element 101 will be received. The upper end of strap 102 may be removably connected to the underside of plate 19 by a U-shaped bracket 104 and bolts 105 extending through openings in the arms of this bracket and connecting into openings in plate 19.

FIG. 11 shows two additional top plates 106 and 107 which meet at 108 and may be detachably secured to plate 19 by screws 109 to increase the width of the working area when desired. Plates 106 and 107 may contain a pattern of openings similar to those in plate 19 to similarly mount a press. In this connection, it is noted that the openings in plate 19 permit mounting of a press to its rear end as well as its forward end if desired.

Figure 11A:
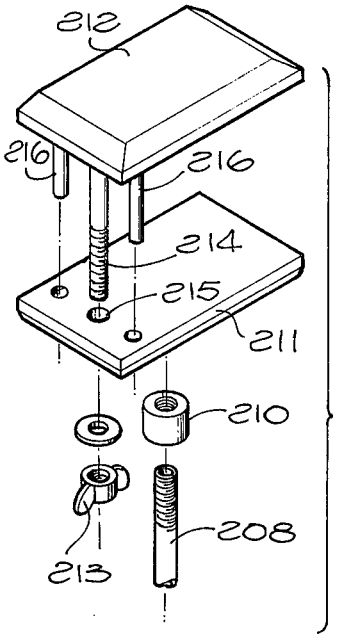
Figure 11B:
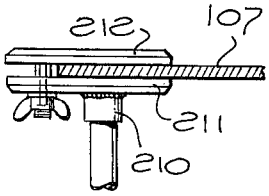

In conjunction with the auxiliary plates 106 and 107, there may be utilized one or more stabilizer units 206 (FIGS. 11, 11*a* and 11*b*), each forming an adjustable leg which supports the associated plate 106 and 107 from the floor at a location spaced outwardly from the main cabinet, in order to take downward forces exerted against an edge portion of plate 106 or 107 by auxiliary loading equipment which may be supported thereon. More particularly, each stabilizer 206 may include two vertical leg sections 207 and 208 connected in end to end relation by a threaded sleeve 209 which permits adjustment of the length of the composite leg, as does the threaded connection of the upper end of section 208 to a sleeve 210 which is welded or otherwise rigidly secured to the underside of the lower one of two horizontal clamping plates 211 and 212. The edge of plate 106 or 107 is clamped vertically between plates 211 and 212, by tightening of a nut 213 on a vertical screw 214 which is carried by upper clamping plate 212 and projects downwardly through an opening 215 in plate 211. Two vertical pins 216 are also carried by upper clamping plate 212 and project downwardly through openings in plate 211 to maintain the two clamping plates in proper relative orientation.

FIG. 12 shows a variational arrangement which may be identical with that of FIGS. 1 to 10 except that there are substituted for the caster wheels 50 four wheels 50*a* which are mounted to turn about fixed horizontal axes 110 relative to the cabinet 17*a*, rather than to swivel in the manner of casters.

FIGS. 13 and 14 illustrate an additional outer cabinet 111 which may be disposed about the cabinet 17 and its carried parts when not in use. This cabinet 111 may be very decorative, and of a size and rectangular shape to fit closely about cabinet 17 when the press is removed therefrom. Cabinet 11 may have an open end 112, adapted to be closed by a swinging door 113, so that after the cabinet or bench 17 has been moved into cabinet 111, from the broken line position of FIG. 13 to the full line position thereof, door 113 may be closed to leave a highly attractive piece of furniture shielding cabinet 17 from view. In this condition, all of the reloading supplies and the press can be contained within the interior of cabinet 17. In order to enable the wheeled cabinet or bench 17 to be moved into outer cabinet 111, the outer cabinet preferably does not have a floor. Also, as seen in FIG. 14, the side wall 114 of outer cabinet 111 which is received adjacent wall 29 of the inner cabinet should have a weakened or open area 115 opposite the weakened region 95 of wall 29. More particularly, this weakened region of the outer cabinet may be formed merely be providing a series of parallel horizontal slits or openings 116 opposite plate 95, enabling the upper and lower portions of the plate to be forced outwardly through and rupture this slitted area upon development of high internal pressures within cabinet 17.

In order to increase the rigidity of cabinet 17 when the top plate and weights are removed therefrom, there may be provided an elongated angular brace member 117, which is pivotally connected at one end 118 (FIG. 2) to rear wall 28 of cabinet 17, and which is detachably connectable at its opposite end 119 to flange 33 of bottom wall 26 at the location of the side door opening of cabinet 17. This brace member 118 may normally be in the upwardly projecting position shown in broken lines at 118' in FIG. 2, and be swung downwardly to its angular position of connection to the bottom only when the top plate is removed and its reinforcing effect is not present.

While certain specific embodiments of the present invention have been disclosed as typical, the invention is of course not limited to these particular forms, but rather is applicable broadly to all such variations as fall within the scope of the appended claims.

I claim:

1. A gun ammunition loading bench comprising:

a cabinet adapted to be supported by a floor surface or the like and to project upwardly therefrom and having walls extending upwardly about a space within the interior of the cabinet;

a rigid generally horizontal top plate extending across the top of said cabinet and adapted to mount an ammunition loading press and supported by said cabinet, with the load of the top plate being transmitted to the cabinet at a predetermined upper level near the top of the cabinet;

a plurality of weights at the underside of said top plate and within said cabinet and spaced horizontally apart and having a mass sufficient to effectively resist displacement of said top plate by very substantial forces exerted thereagainst upon actuation of said loading press; and connector means attaching said weights at upper ends thereof to said top plate in depending relation, with the mass of said weights being suspended from the top plate and hanging downwardly therefrom to a level well below said upper level at which the load of the top plate is taken by said cabinet.

2. A loading bench as recited in claim 1, in which said top plate and said weights are removable from said cabinet and separable from one another and adapted to be used separately from the cabinet with said plate resting on a generally horizontal surface and carrying a loading press, and with said weights resting on a portion of said plate to hold it downwardly on said horizontal surface.

3. A loading bench as recited in claim 1, in which said cabinet has at least one temporary support surface on which one of said weights can rest prior to attachment of the weights to said top plate, there being connector means for attaching the upper end of said one weight to said top plate and adapted to pull said weight upwardly away from said temporary support surface as the weight is connected to the top plate.

4. A loading bench as recited in claim 1, including threaded fasteners projecting downwardly through openings in said top plate and connectable threadedly into said weights in suspending relation and adapted to pull said weights slightly upwardly upon tightening of the fasteners, said cabinet carrying temporary support surfaces on which said weights are supported before tightening of said fasteners and from which the weights are pulled slightly upwardly as the fasteners are tightened.

5. A loading bench as recited in claim 1, including at least one removable tray extending between and supported by said two weights.

6. A loading bench as recited in claim 1, including additional weights means removably carried within said cabinet at a location beneath said first mentioned weights.

7. A loading bench as recited in claim 1, including a foot pedal element carried by a lower portion of the cabinet to be engaged and held downwardly by the foot of a user in resisting upward forces exerted against the bench by the loading press.

8. A loading bench as recited in claim 1, including an outrigger bracket projecting from the cabinet at one side thereof, and additional weight means to be placed on said outrigger bracket for resisting upward movement thereof.

9. A loading bench as recited in claim 8, including trays extending between and supported by said two weights and having end flanges slidably received within recesses in said weights to be supported thereby, one of said walls of the cabinet containing a vertical recess above which an end portion of said top plate overhangs, said end portion of the top plate containing an elongated slot to which a loading press is connectable.

10. A loading bench as recited in claim 9, in which said walls of the cabinet have upper edge portions defining a space within which said top plate is received, and having vertical slots and fasteners extending therethrough into said top plate to secure the top plate to said walls, there being an outrigger bracket detachably connectable to an end of said cabinet and projecting outwardly therefrom and additional weights adapted to be mounted selectively either on said outrigger bracket or within a lower portion of said cabinet, there being vertically adjustable stabilizer feet mounted to said outrigger bracket and to said cabinet at different sides thereof for engaging a floor surface.

11. A gun ammunition loading bench comprising:

a cabinet adapted to be supported by a floor surface or the like and project upwardly therefrom;

a rigid top plate carried by an upper portion of said cabinet and extending generally horizontally and constructed to mount an ammunition loading press;

a plurality of weights carried at the underside of said top plate within said cabinet and having a mass sufficient to prevent displacement of said top plate by at least some of the very substantial forces exerted thereagainst upon actuation of said loading press; and connector means for securing said weights to said top plate and detachable to permit separation of the weights from the top plate;

said top plate and said weights being removable from said cabinet and adapted to be used separately from the cabinet with said plate resting on a generally horizontal surface and carrying a loading press, and with said weights resting on a portion of said plate to hold it downwardly on said horizontal surface.

12. A loading bench as recited in claim 11, in which said top plate contains an elongated slot located near and generally paralleling an edge of the plate, and a plurality of apertures, arranged in a pattern to receive fasteners for securing any of various different types of loading presses to the plate.

13. A loading bench as recited in claim 11, in which said cabinet has at least one door at one side thereof providing access to the interior of the cabinet and through which said weights are removable from the cabinet.

14. A loading bench as recited in claim 11, in which said cabinet has a generally vertically extending wall containing a generally vertically extending recess, said top plate having a portion near one edge thereof projecting over the upper end of said recess in overhanging relation and apertured to receive fasteners for securing a loading press thereto.

15. A loading bench as recited in claim 11, in which said cabinet has wheels adapted to engage and roll along a floor surface to enable movement of the cabinet therealong, there being a plurality of stabilizing feet projecting downwardly for engagement with a floor surface at different sides of the cabinet and adjustable vertically to contact the floor surface.

16. A loading bench as recited in claim 11, including an outrigger bracket projecting from the cabinet at one side thereof, additional weight means to be placed on said outrigger bracket for resisting upward movement thereof, and a stabilizing foot connected to an outer portion of said outrigger bracket and projecting downwardly for engagement with a floor surface and adjustable upwardly and downwardly relative to said bracket.

17. A loading bench as recited in claim 11, in which said cabinet has a generally vertically extending wall containing a generally vertically extending recess, said top plate having a portion near one edge thereof projecting over the upper end of said recess in overhanging relation and apertured to receive fasteners for securing a loading press thereto, and a tray detachably connected to said wall and having a mounting portion projecting into said recess.

18. A loading bench as recited in claim 11, in which said cabinet has walls one of which contains an opening, there being a plate disposed across said opening and adapted to be opened by explosive force of an intensity which can be resisted by one or more others of said walls.

19. A loading bench as recited in claim 11, in which said cabinet has generally vertical walls with the upper portions thereof defining a space receiving said top plate, said upper portions of said walls containing openings to pass fasteners therethrough into said top plate to releasably secure it to the cabinet.

20. A loading bench as recited in claim 11, including a foot pedal adapted to be detachably connected to said plate when in use separately from said cabinet and to extend downwardly to a location at which a user may exert force downwardly thereagainst by his foot to resist upward forces exerted by the press.

21. A loading bench as recited in claim 11, including a loading press as an element of the claim mounted to said top plate.

22. The combination comprising:

a rigid mounting plate adapted to be placed on a generally horizontal surface;

an ammunition loading presss connected to said plate near an edge thereof, and weight means placed upon the upper side of said plate and holding it downwardly against said surface and resisting displacement of the plate by forces exerted by said press.

23. The combination as recited in claim 22, including a structure connected to and extending downwardly from said mounting plate and having a foot pedal at a level beneath said plate against which the foot of a user can exert downward force to resist upward displacement of the connected portion of said plate by forces exerted by the press.

24. The combination as recited in claim 23, in which said structure is an elongated flexible element suspending said foot pedal from said plate and detachably connected to said plate at its upper end and adjustable in length to vary the position of said pedal.

25. A loading bench comprising:

a cabinet to be supported on a floor suface and having generally vertical outer walls;

a top plate connected to the top of said cabinet and having a portion projecting horizontally beyond one of said outer walls of the cabinet;

means for mounting ammunition loading equipment on said plate; and a stabilizer leg assembly adapted to project upwardly from said floor surface and connect to and support said portion of said top plate at a location offset horizontally beyond said one outer wall of the cabinet.

26. A loading bench as recited in claim 25, in which said stabilizer leg assembly includes clamping elements at its upper end adapted to be detachably and rigidly clamped against upper and lower sides of said top plate.

27. A loading bench as recited in claim 26, in which said leg assembly includes a plurality of leg sections which are relatively vertically adjustable to vary the height of said assembly.

* * * * *